US008933870B2

(12) United States Patent
Higashijima et al.

(10) Patent No.: US 8,933,870 B2
(45) Date of Patent: Jan. 13, 2015

(54) DRIVE CIRCUIT FOR DISPLAY PANEL, AND DISPLAY DEVICE

(75) Inventors: Hiroyuki Higashijima, Konosu (JP); Takahiro Ochiai, Chiba (JP); Mitsuru Goto, Chiba (JP)

(73) Assignees: Japan Display Inc., Tokyo (JP); Panasonic Liquid Crystal Display Co., Ltd., Himeji-shi (JP)

( * ) Notice: Subject to any disclaimer, the term of this patent is extended or adjusted under 35 U.S.C. 154(b) by 272 days.

(21) Appl. No.: 13/239,789

(22) Filed: Sep. 22, 2011

(65) Prior Publication Data

US 2012/0075282 A1 Mar. 29, 2012

(30) Foreign Application Priority Data

Sep. 27, 2010 (JP) ..... 2010-215597

(51) Int. Cl.
*G09G 3/36* (2006.01)

(52) U.S. Cl.
CPC ..... *G09G 3/3677* (2013.01)
USPC ..... 345/100; 345/99; 345/87; 345/691; 345/204; 345/212

(58) Field of Classification Search
USPC ..... 345/100, 204–212
See application file for complete search history.

(56) References Cited

U.S. PATENT DOCUMENTS

2006/0208997 A1 * 9/2006 Sunohara et al. ..... 345/100
2007/0070020 A1 * 3/2007 Edo et al. ..... 345/100
2010/0123654 A1 5/2010 Kimura

FOREIGN PATENT DOCUMENTS

JP 2007-095190 4/2007
JP 2010-140023 6/2010

* cited by examiner

*Primary Examiner* — Grant Sitta
(74) *Attorney, Agent, or Firm* — Antonelli, Terry, Stout & Kraus, LLP.

(57) ABSTRACT

In a unit drive circuit in each stage in a shift register, a transistor which is maintained in ON state during a period where the unit drive circuit in the stage does not perform an outputting operation is configured not to generate Vth shift. As switches, transistors T6A, T6B are connected between the output terminal OUT and AC power sources VA, VB. At least one of T6A, T6B is brought into ON state and T6A, T6B are alternately brought into OFF state during the period other than the outputting operation period. VA, VB supply L level during a period where T6A, T6B are in ON state, while VA, VB supply a ground potential GND which is an intermediate potential between an H level and an L level during a period where T6A, T6B are in OFF state.

10 Claims, 6 Drawing Sheets

DRIVE CIRCUIT FOR DISPLAY PANEL, AND DISPLAY DEVICE

CROSS-REFERENCE TO RELATED APPLICATION

The present application claims priority from Japanese application JP2010-215597 filed on Sep. 27, 2010, the content of which is hereby incorporated by reference into this application.

BACKGROUND OF THE INVENTION

1. Field of the Invention

The present invention relates to a drive circuit for a display panel and an image display device using the drive circuit.

2. Description of the Prior Art

An image display device such as a liquid crystal display device includes a display panel where pixel circuits corresponding to respective pixels are arranged two-dimensionally. The display panel includes gate lines corresponding to respective scanning lines for the pixels. The gate lines are connected to a gate line drive circuit on a side of a display area. The gate line drive circuit includes a shift register which outputs a voltage enabling writing data into the pixel circuits sequentially for each scanning line.

The shift register used in the gate line drive circuit or the like can be formed on a side of the display area of the display panel. In this case, the shift register is formed using thin film transistors (TFT) where a semiconductor layer is formed using amorphous silicon (a-Si) on the same substrate as the pixel circuits.

The shift register is constituted of unit register circuits (unit drive circuits) in plural stages which are connected by a cascade junction. Basically, the unit register circuit on each stage performs an operation of outputting a selective pulse one time sequentially from one end to the other end of a unit register circuit column in vertical scanning or the like. That is, each of the plurality of basic register circuits which constitute the shift register provided to the gate line drive circuit, during 1 frame period, outputs a High (H) level which is a predetermined positive potential as a selective pulse only when the pixel circuits which are arranged along the scanning line corresponding to the basic register circuit are controlled, and outputs a Low (L) level which is a predetermined negative potential as a selective pulse during the most period corresponding to other scanning lines.

FIG. 6 is a circuit diagram of a basic register circuit according to a prior art. Each transistor which constitutes the circuit is turned on when a potential of an H level is applied to a gate thereof, and is turned off when a potential of an L level is applied to the gate thereof. In an initial state, a node N1 is set to an L level, and a node N2 is set to an H level. An output transistor T5 is connected between an output terminal OUT of a unit register circuit in a k-th stage and a clock signal line CLK(k), and a transistor T6 is connected between the terminal OUT and a power source VGL at an L level.

The unit register circuits which constitute the shift register generate an output pulse sequentially. When an output pulse G(k−1) of a preceding stage is inputted to the unit register circuit in a k-th stage, the node N1 (one end of a capacitor C1) is connected to a power source VGH so that a potential at the node N1 becomes an H level whereby the transistor T5 is turned on. In a state where a potential at the node N1 is at the H level, the node N2 is connected to the power source VGL so that a potential at the node N2 becomes an L level whereby the transistor T6 is turned off. During a period where the transistors T5 and T6 are in such a state (outputting operation period), the potential at the output terminal OUT is determined corresponding to a clock signal CLK(k). That is, when a pulse of an H level is outputted to the clock signal CLK(k), during the pulse outputting period, the potential at the node N1 is further elevated through the capacitor C1 connected between a source and a gate of the transistor T5 so that a pulse Gk of an H level is generated at the output terminal OUT.

The unit register circuit in a (k+1)th stage, when the output pulse Gk of k-th stage is inputted to the unit register circuit in the (k+1)th stage, is operated in the same manner as the unit register circuit in the k-th stage, and generates an output pulse G(k+1) in synchronism with a pulse of a clock signal CLK (k+1). Further, the unit register circuit in a (k+2)th stage generates an output pulse G (k+2) in synchronism with a pulse of a clock signal CLK(k+2).

When the output pulse G(k+2) of the (k+2)th stage is inputted to the unit register circuit in a k-th stage, the node N1 is connected to the power source VGL so that the potential at the node N1 becomes an L level again. At the same time, the node N2 is connected to the power source VGH in response to the pulse of the clock signal CLK(k+2) and a potential at the node N2 becomes an H level again.

In this manner, during the period other than the outputting operation period, the node N1 is an L level, the node N2 is an H level, the transistor T5 is in an OFF state, and the transistor T6 is in an ON state. In such a state, a potential at the output terminal OUT is set to an L level given by the power source VGL.

A pulse of a clock signal CLK is supplied to a drain of the transistor 15 even during period other than the outputting operation period, and the pulse tries to elevate the potential at the node N1 through a capacitor between the gate and the drain of the transistor T5. A transistor T2 connected between the node N1 and the power source VGL is in an ON state when a potential of an H level at the node N2 is applied to the gate terminal during a period other than the output operation period so that the elevation of the potential at the node N1 described above is prevented.

SUMMARY OF THE INVENTION

During an operation period of the shift register, the unit register circuit on each stage outputs an L level except for timing at which a selective pulse supplied to a scanning line corresponding to the own stage is generated. That is, most of 1 frame period becomes a period other than the output operation period and hence, the transistors T6, T2 are kept in an ON state for a long time. As a result, a threshold voltage Vth of the transistors T6, T2 is shifted in the positive direction, and ability of the transistor T6 to fix the output terminal OUT at an L level and ability of the transistor T2 to fix the node N1 at an L level are lowered. As a result, there arises a drawback that an operation of the unit register circuit becomes unstable. This Vth shift occurs conspicuously in an a-Si transistor, and causes a particular problem in an image display device in which drive circuits are formed using a-Si TFTs. For example, there may be a case where when a positive bias voltage of 30 volts is applied between a gate and a source of an a-Si TFT for approximately three hours under an environment of 70° C., the threshold voltage Vth is elevated by approximately 10 volts. Here, by applying a bias in the direction opposite to the direction when the threshold voltage Vth is shifted in the positive direction to the transistor, the shift of the threshold voltage Vth in the negative direction is generated this time so that the threshold voltage Vth can be restored. However, the power consumption of a circuit which cyclically changes the bias voltage become large in general compared to the power consumption of a circuit which does not change the bias voltage. This phenomenon can be explained as follows. For example, qualitatively, in the circuit which does not change a bias voltage, it is sufficient for a power source to supply a charge having potential energy of an L level, while in the circuit which changes a bias voltage, a power source is required also to generate a charge to which potential energy of an H level is also given. Further, extra energy is consumed by an amount necessary for changing the potential energy of the charge between an L level and an H level corresponding to a change in the direction of the bias.

The present invention has been made to overcome the above-mentioned drawbacks, and it is an object of the present invention to provide a drive circuit which can suppress a shift of a threshold voltage and can reduce the increase of power consumption brought about by such suppression of the shift of the threshold voltage, and an image display device which uses the drive circuit.

According to one aspect of the present invention, there is provided a drive circuit for driving a display panel having a plurality of pixels, wherein the drive circuit includes: a plurality of unit drive circuits which are provided for respective groups formed by dividing the plurality of pixels, the unit drive circuit outputting a drive signal which becomes a first potential at the time of driving the group of pixels and becomes a second potential at the time of non-driving the group of pixels during a common control period among the groups of pixels; and first to n-th power source circuits (n being a natural number of 2 or more) each of which selectively outputs a third potential which is an intermediate potential between the first potential and the second potential and the second potential. The unit drive circuit includes: a selective pulse output circuit which outputs a selective pulse having the first potential during an outputting operation period set sequentially in the control period for every group of pixels; and a k-th output terminal switch which is formed of a transistor and establishes or interrupts the connection between an output terminal of the unit drive circuit and the k-th power source circuit (k being an integer satisfying $1 \leq k \leq n$). At least one of the first to n-th output terminal switches is brought into an ON state, and the first to n-th output terminal switches are alternately brought into an OFF state during the control period other than the outputting operation period. The k-th power source circuit outputs the second potential during a period where the k-th output terminal switch is in an ON state and outputs the third potential within at least a portion of a period where the k-th output terminal switch is in an OFF state.

According to another aspect of the present invention, in the drive circuit having the above-mentioned constitution, the selective pulse output circuit includes a transistor which is turned on when the first potential is applied to a gate terminal thereof and is turned off when the second potential is applied to the gate terminal thus establishing or interrupting the connection between a clock signal line and the output terminal, and outputs the selective pulse in response to a clock pulse from the clock signal line by turning on the transistor during the outputting operation period. The unit drive circuit further includes a k-th gate terminal switch which is formed of a transistor and establishes or interrupts the connection between the gate terminal and the k-th power source circuit. The k-th gate terminal switch is operated in synchronism with the k-th output terminal switch.

According to still another aspect of the present invention, there is provided a drive circuit for driving a display panel having a plurality of pixels, wherein the drive circuit includes: a plurality of unit drive circuits which are provided for respective groups formed by dividing the plurality of pixels, the unit drive circuit outputting a drive signal whose potential is changed over between at the time of driving the group of pixels and at the time of non-driving the group of pixels during a common control period among the groups of pixels; and first to n-th power source circuits (n being a natural number of 2 or more) each of which selectively outputs a third potential which is an intermediate potential between a first potential and a second potential and the second potential. The unit drive circuit includes: a selective pulse output circuit which includes a transistor which is turned on when the first potential is applied to a gate terminal thereof and is turned off when the second potential is applied to the gate terminal thus establishing or interrupting the connection between a clock signal line and an output terminal of the unit drive circuit, and outputs a selective pulse to the drive signal in response to a clock pulse from the clock signal line by turning on the transistor during an output operation period set sequentially during the control period for every group of pixels; and a k-th gate terminal switch which is formed of a transistor and establishes or interrupts the connection between the gate terminal of the transistor and the k-th power source circuit (k being an integer satisfying $1 \leq k \leq n$). During the control period other than the outputting operation period, at least one of the first to n-th gate terminal switches is brought into an ON state, and the first to n-th gate terminal switches are alternately brought into an OFF state. The k-th power source circuit outputs the second potential during a period where the k-th gate terminal switch is in an ON state and outputs the third potential within at least a portion of a period where the k-th gate terminal switch is in an OFF state.

In one preferred mode of the present invention, in the drive circuit, the output terminal switch or the gate terminal switch is formed of an amorphous silicon thin film transistor.

In another preferred mode of the present invention, in the drive circuit, the third potential is a ground potential of the drive circuit.

According to still another aspect of the present invention, there is provided an image display device which includes: the above-mentioned drive circuit according to the present invention; and a display panel driven using the drive circuit.

DETAILED DESCRIPTION OF THE INVENTION

A mode for carrying out the present invention (hereinafter referred to as an embodiment) is explained in conjunction with drawings hereinafter.

Figure 1:
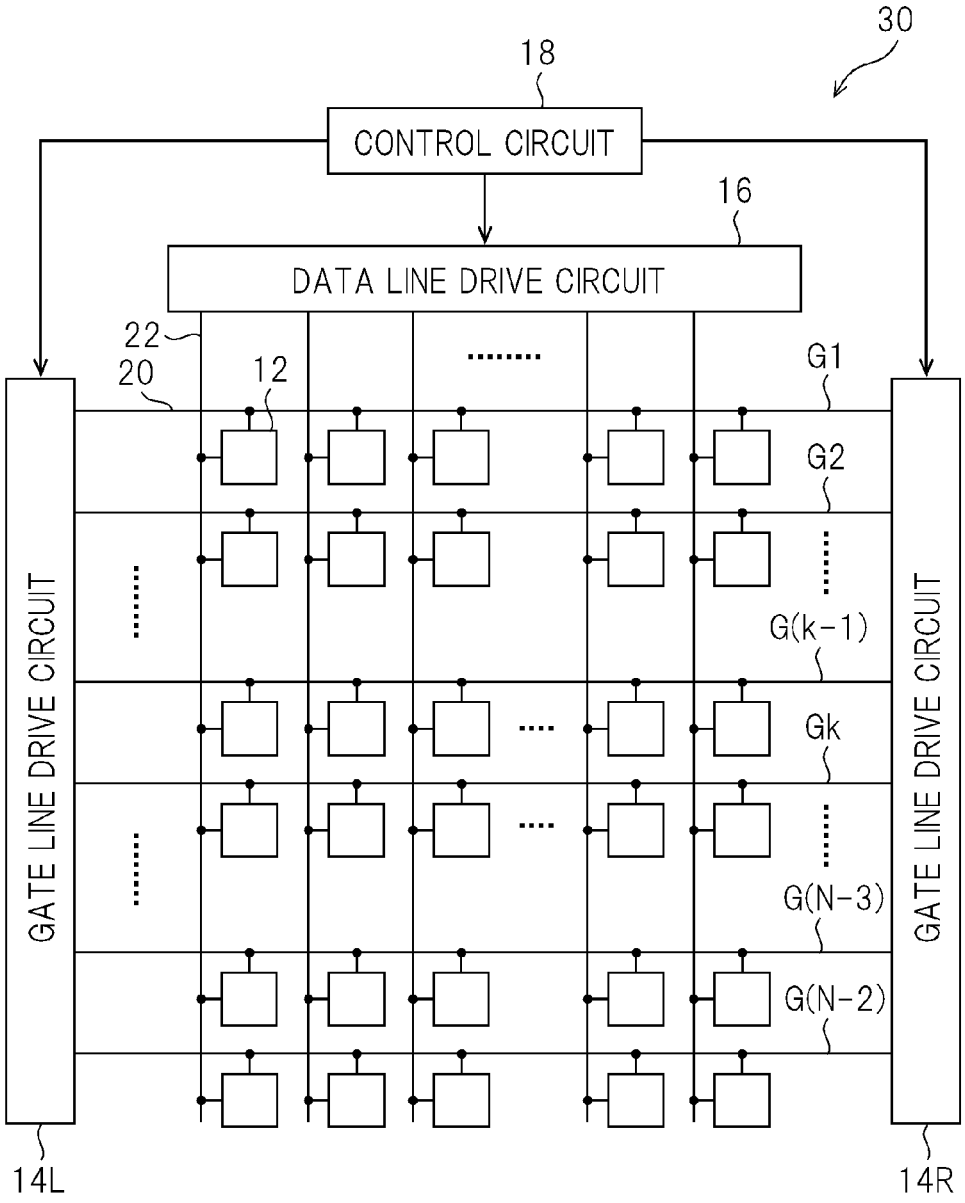
FIG. 1 is a schematic view showing the constitution of an image display device according to an embodiment of the present invention.

FIG. 1 is a schematic view showing the constitution of an image display device 10 of this embodiment. The image display device 10 is a liquid crystal display or the like, for example. The image display device 10 includes a plurality of pixel circuits 12, a gate line drive circuit 14, a data line drive circuit 16 and a control circuit 18.

The pixel circuits 12 are arranged on a display part in a matrix array corresponding to pixels.

A plurality of gate signal lines 20 are connected to the gate line drive circuit 14. The plurality of pixel circuits 12 which are arranged in the horizontal direction (in the row direction) are connected to each gate signal line 20. The gate line drive circuit 14 outputs gate signals to the plurality of gate signal lines 20 sequentially so as to bring the pixel circuits 12 connected to the gate signal line 20 into a state where data can be written in the pixel circuits 12.

A plurality of data lines 22 are connected to the data line drive circuit 16. The plurality of pixel circuits 12 which are arranged in the vertical direction (in the columnar direction) are connected to each data line 22. The data line drive circuit 16 outputs image data of an amount corresponding to 1 scanning line to the plurality of data lines 22. Data outputted to the respective data lines 22 are written in the pixel circuits 12 which are brought into a data writable state in response to the gate signals. The respective pixel circuits 12 control a quantity of light emitted from the pixels in accordance with written data.

The control circuit 18 controls an operation of the gate line drive circuit 14 and an operation of the data line drive circuit 16.

The image display device 10 includes, as the gate line drive circuit 14, a gate line drive circuit 14L which is arranged on a left side of the display part, and a gate line drive circuit 14R which is arranged on a right side of the display part. The left and right gate line drive circuits 14 have the same circuit constitution, are simultaneously operated in synchronism with each other under the control of the control circuit 18, and supply the gate signals to the respective gate signal lines 20 respectively. That is, the right and left gate line drive circuits 14 supply the same drive signal from both sides of the gate signal line 20. By supplying a pulse from both sides of the gate signal line 20, the influence exerted by the deterioration of waveform of a drive signal caused by CR of the gate signal line 20 can be reduced. The gate line drive circuit 14 sequentially drives the respective gate signal lines 20 at timing offset from each other by 1H.

Figure 2:
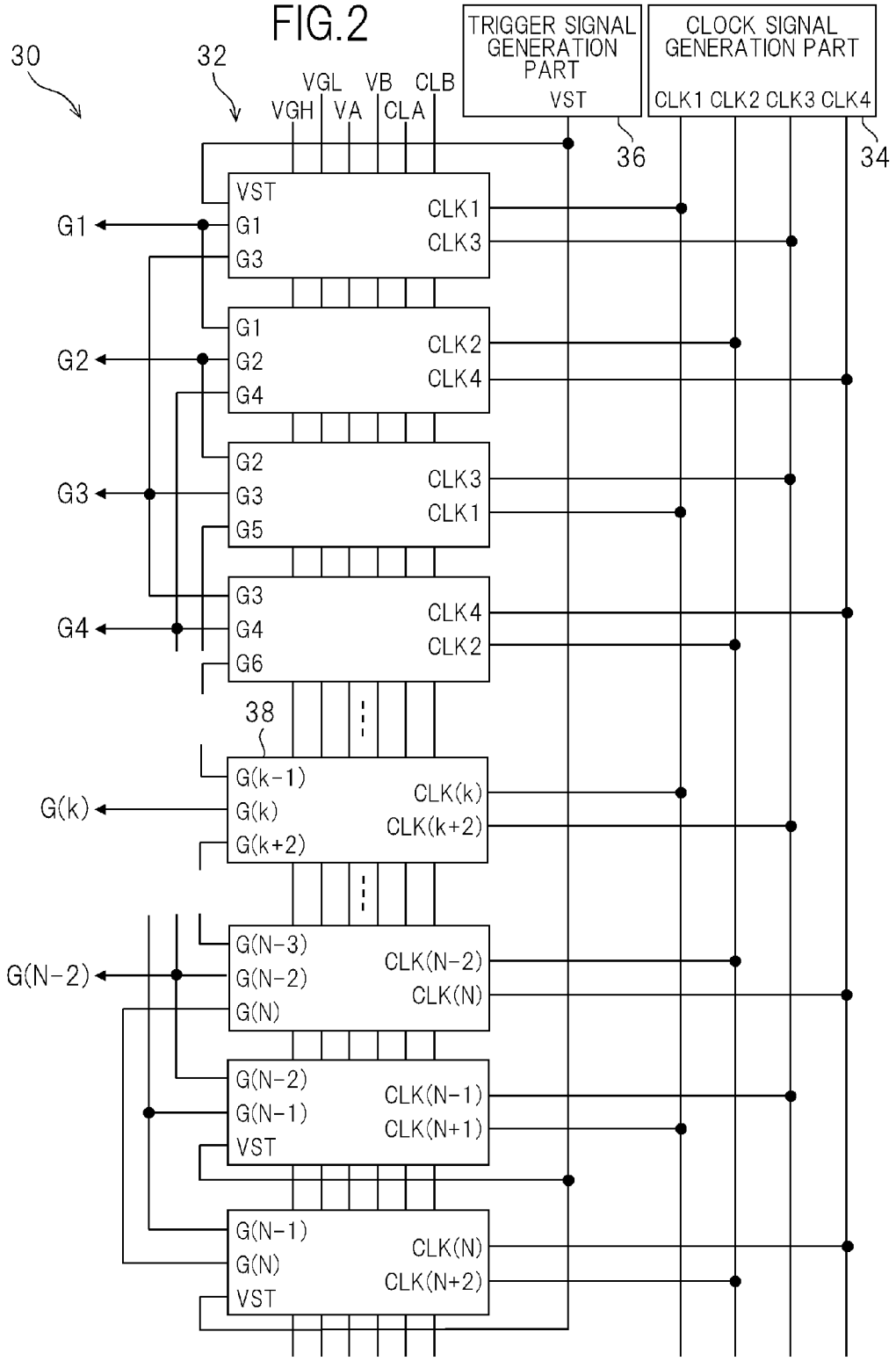
FIG. 2 is a schematic view showing the constitution of a shift register used for scanning gate signal lines of the image display device.

FIG. 2 is a schematic view showing the constitution of a shift register 30 used for scanning the gate signal lines 20 of the image display device 10. The shift register 30 includes a shift register part 32, a clock signal generation part 34 and a trigger signal generation part 36. The shift register part 32 is provided to the gate line drive circuit 14, and the clock signal generation part 34 and the trigger signal generation part 36 are provided to the control circuit 18, for example. The shift register part 32 is constituted of unit register circuits 38 in plural stages which are connected to each other in a cascade junction.

The shift register part 32 is driven with clocks of 4 phases. The clock signal generation part 34 generates clock signals CLK1 to CLK4 corresponding to such 4 phases. A pulse having a width of 1H is generated at a 4H cycle in response to each clock signal. The unit register circuit 38 in each stage is associated with one of clock signals of the plurality of phases as a clock signal of a phase which determines timing of an output pulse in the stage (output control clock signal). To be more specific, the shift register part 32 is associated with the output control clock signals in order of CLK1, CLK2, CLK3, CLK4, CLK1, from a leading stage (upper side) thereof to a trailing stage (lower side) thereof.

The clock signal generation part 34 generates clock pulses in order of CLK1, CLK2, CLK3, CLK4, CLK1, and the clock signals whose phases change sequentially from the leading stage to the trailing stage are supplied to the gate line drive circuit 14 as the output control clock signals.

The trigger signal generation part 36 generates a trigger signal VST at the time of starting a shift operation. To be more specific, the trigger signal generation part 36 outputs a pulse which causes the trigger signal VST to rise an H level.

As described previously, the shift register part 32 has the constitution where the plurality of unit register circuits 38 are connected in cascade connection, and the unit register circuits 38 output pulses from output terminals sequentially from the leading stage.

The total number of stages of the shift register part 32 is expressed as N. The plural stages of the unit register circuits 38 include main stages where the gate signal line 20 is connected to the output terminal, and dummy stages which are attached to trailing ends of a column constituted of the main stages and are not connected to the gate signal lines 20. The value of the total number of stages N is determined corresponding to the number of scanning lines of the image display device 10, that is, corresponding to the number of gate signal lines 20 and the number of stages of dummy stages. In this embodiment, the dummy stages are provided in two stages. To express the output of the unit register circuit 38 in a k-th stage as Gk (k: natural number satisfying $1 \leq k \leq N$), outputs G(N−1) and GN which are outputs in the dummy stages are not outputted to the gate signal lines 20, and the output $G\lambda$ of the unit register circuit 38 in the $\lambda$ stage ($\lambda$: natural number satisfying $1 \leq \lambda \leq N-2$) which is the main stage is outputted to the gate signal line 20.

FIG. 2 shows the connection relationship of respective input/output terminals of the respective unit register circuits 38. To simplify the expression, a symbol such as CLK($\zeta$), for example, is used with respect to a clock signal. In this expression, the clock signal CLK($\zeta$) whose phase is expressed by the number $\zeta$ exceeding 4 means a clock signal CLK($\xi$) expressed using a remainder $\xi$ obtained when $\zeta$ is divided by 4.

Figure 3:
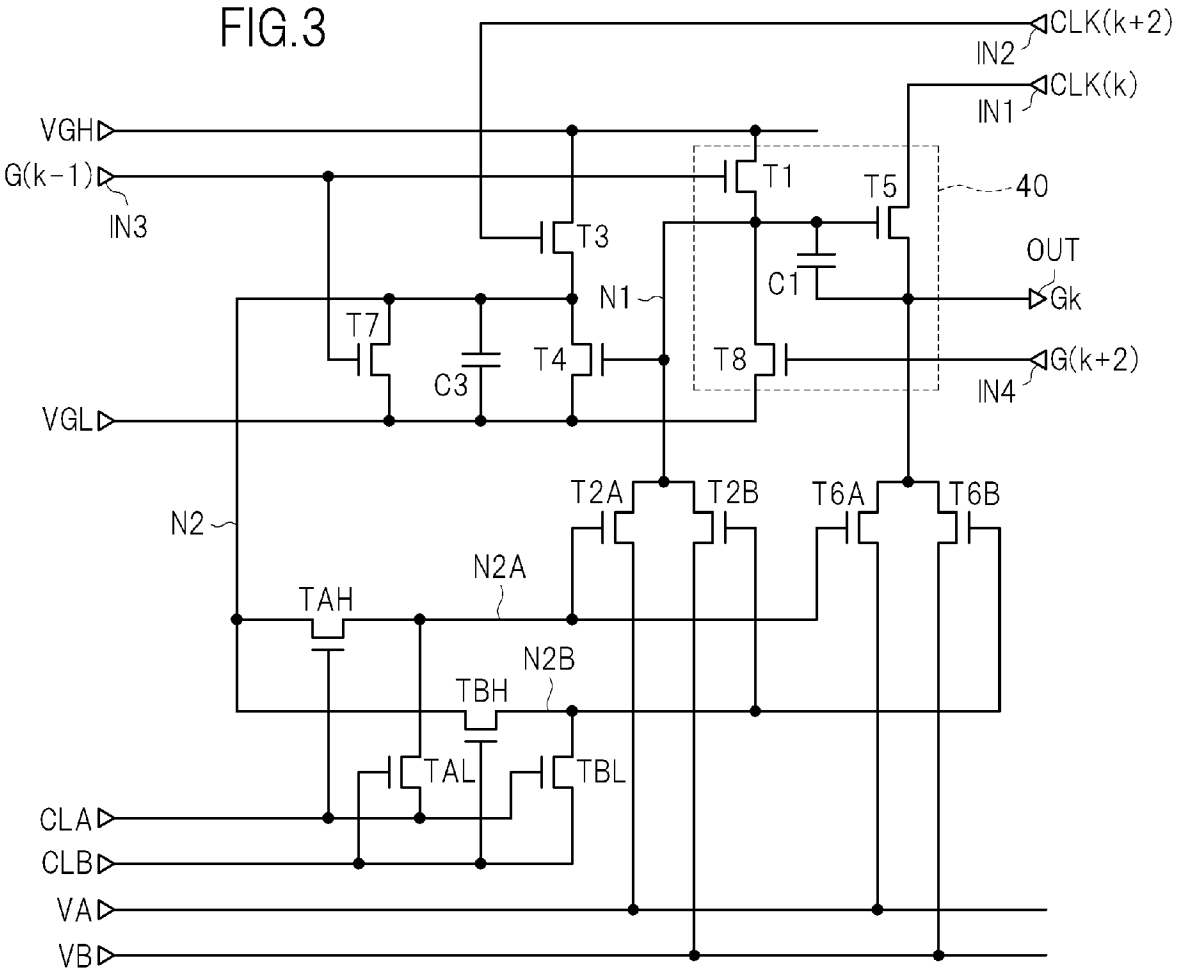
FIG. 3 is a schematic circuit diagram showing a unit register circuit which is connected by a cascade junction in a shift register.

FIG. 3 is a schematic circuit diagram of the unit register circuit 38, and shows the unit register circuit 38 in the k-th stage.

The unit register circuit 38 includes n-channel transistors T1, T2A, T2B, T3 to T5, T6A, T6B, T7, T8, TAH, TBH, TAL and TBL and capacitors C1, C3. These respective transistors are formed of an a-Si TFT. These respective transistors are turned on when a potential of an H level is applied to a gate terminal and are turned off when a potential of an L level is applied to the gate terminal.

The unit register circuit 38 in a k-th stage includes an output terminal OUT which outputs a pulse Gk of the own stage. The unit register circuit 38 also includes input terminals IN1, IN2 as terminals to which a clock signal is inputted, an input terminal IN3 as a terminal to which a trigger signal indicative of starting of an output operation period is inputted, and an input terminal IN4 as a terminal to which a trigger signal indicative of finishing of the output operation period is inputted. The input terminal IN1 is connected to the clock signal line CLK(k), and the input terminal IN2 is connected to the clock signal line CLK(k+2). A pulse G(k−1) is inputted to the input terminal IN3 from a (k−1)th stage, and a pulse G(k+2) is inputted to the input terminal IN4 from a (k+2)th stage. The trigger signal VST is inputted to the input terminal IN3 of the first stage and the input terminal IN4 of the dummy stages (that is, (N−1) th stage, N-th stage) from the trigger signal generation part 36.

A voltage of an H level which is a predetermined positive voltage is supplied to each unit register circuit 38 from the power source VGH, and a voltage of an L level which is a predetermined negative voltage is supplied to each unit register circuit 38 from the power source VGL.

Each unit register circuit 38 is connected to clock signal lines CLA, CLB and AC power sources VA, VB. The clock signal lines CLA, CLB supply a clock which is cyclically changed over between an H level and an L level to the unit register circuit 38. In this embodiment, the clock signals CLA, CLB are set to have phases opposite to each other. The AC power sources VA, VB selectively output an intermediate potential between an H level and an L level and a potential of the L level. These AC power sources, in this embodiment, cyclically change over the output potentials in synchronism with the clock signals CLA, CLB. To be more specific, the AC power sources VA outputs the potential at an L level during a period where the clock signals CLA is at an H level, and outputs intermediate potential during a period where the clock signal CLA is at an L level. In the same way, VB outputs L level during CLB is at an H level, and outputs the intermediate potential during CLB is at an L level. The intermediate potentials which the AC power sources VA, VB output are set to a ground potential GND of the gate line drive circuit 14 or the like in this embodiment.

The transistors T5, T1, T8 and the capacitor C1 constitute a selective pulse output circuit 40 which outputs a selective pulse Gk from the output terminal OUT as a drive signal. The transistor T1 functions as a switch element which establishes or interrupts the connection between a node N1 to which a gate terminal of the transistor T5 is connected and the power source VGH. Agate terminal of the transistor T1 is connected to an input terminal IN3, and sets the node N1 to an H level when an output pulse G(k−1) of a (k−1)th stage is inputted to the input terminal IN3.

The transistor T8 functions as a switch element which establishes or interrupts the connection between the node N1 and the power source VGL. A gate in the transistor T8 is connected to the input terminal IN4, and set the node N1 to an L level when an output pulse G(k+2) of a (k+2)th stage is inputted to the input terminal IN4.

A drain of the transistor T5 constitutes the input terminal IN1, and a source of the transistor T5 is connected to the output terminal OUT. The capacitor C1 is connected between the gate and the source of the transistor T5. The transistor T5 is turned on during a period where a potential at the node N1 is at an H level (outputting operation period), fetches a clock pulse outputted to the clock signal lines CLK(k) during this period from the input terminal IN1, and outputs a pulse Gk to the output terminal OUT.

The transistor T3 functions as a switch element which establishes or interrupts the connection between the node N2 and the power source VGH. A gate terminal of the transistor T3 is connected to the input terminal IN2. The transistor T3 is turned on when a pulse is inputted through the clock signal line CLK(k+2) to the input terminal IN2 so that a potential of an H level is applied to the node N2. The capacitor C3 is connected between the node N2 and the power source VGL. The capacitor C3 can maintain the potential at the node N2 at an H level even after the transistor T3 is turned off.

The transistors T4, T7 function as switch elements which establish or interrupt the connection between the node N2 and the power source VGL. A gate of the transistor T7 is connected to the input terminal IN3. When a pulse G(k−1) is inputted to the input terminal IN3, the transistor T1 sets the potential at the node N1 at an H level as described above, and the transistor T7 sets a potential at the node N2 to an L level. A gate of the transistor T4 is connected to the node N1 so that a potential at the node N2 is maintained at an L level during a period where a potential at the node N1 is held at an H level. When the transistor T3 changes over the potential at the node N2 from an L level to an H level, the transistor T8 simultaneously changes over the potential at the node N1 from an H level to an L level and hence, the transistor T4 is turned off. In this manner, the nodes N1, N2 are set to potential levels opposite to each other. That is, with respect to a control period of the shift register, the potential at the node N2 is at an L level during a period where the potential at the node N1 is at an H level (output operation period), and the potential at the node N2 is at an H level during a period where the potential at the node N1 is at an L level (period other than the output operation period). Here, the shift register control period should not be construed in a limiting manner as a period for one-time shift operation, and may be construed as a period which extends over a shift operation which is carried out plural times.

The transistors T6A, T6B are connected to the output terminal OUT besides the above-mentioned transistor T5. The transistors T6A, T6B are respectively output terminal switches which establish or interrupt the connection between the output terminal OUT and the AC power sources VA, VB. In the transistors T6A, T6B, a drain is connected to the output terminal OUT and a source is connected to the AC power sources VA, VB respectively. An ON/OFF state of the transistors T6A, T6B is controlled in accordance with potentials at nodes N2A, N2B connected to gates of the transistors T6A, T6B respectively.

The nodes N2A, N2B are respectively connected to the node N2 through the transistors TAH, TBH. In the transistors TAH, TBH, a gate is connected to the clock signal lines CLA, CLB. An ON/OFF operation of the transistors TAH, TBH is cyclically changed over in response to clock signals from the clock signal lines CLA, CLB. In a state where the potential at the node N2 is at an H level, that is, during a period other than the output operation period, when the transistor TAH is turned on, a potential at the node N2A is set to an H level, while when the transistor TBH is turned on, a potential at the node N2B is set to an H level.

On the other hand, the transistors TAL, TBL are switching elements for resetting the potentials at the nodes N2A, N2B to an L level. In this embodiment, the transistor TAL is connected between the node N2A and the clock signal line CLA, and an ON/OFF state of the transistor TAL is changed over in response to a clock signal supplied to a gate from the clock signal line CLB. The transistor TBL is connected between the node N2B and the clock signal line CLB, and an ON/OFF state of the transistor TBL is changed over in response to a clock signal supplied to a gate from the clock signal line CLA.

Between the node N1 and the power source, in addition to the above-mentioned transistor T8, the transistors T2A, T2B are connected. The transistors T2A, 12B are respectively gate terminal switches which establish or interrupt the connection between the gate terminal of the transistor T5 and the AC power sources VA, VB respectively. In the transistors T2A, T2B, a drain is connected to the node N1, and a source is connected to the AC power sources VA, VB respectively. In the transistors 12A, T2B, in the same manner as the transistor as T6A, T6B, an ON/OFF state is controlled in accordance with potentials at the nodes N2A, N2B connected to gates of the transistors T2A, T2B respectively.

Next, the manner of operation of the shift register 30 is explained. Driving of the shift register starts when the trigger signal generation part 36 generates a pulse of a trigger signal VST and inputs the pulse to the input terminal IN3 of the unit register circuit 38 in the first stage at a head of an image signal of 1 frame. In the unit register circuit 38 in dummy stages, a pulse G(k+2) is not supplied to the input terminal IN4 and hence, when a shift operation of the previous frame is finished, a potential at the node N1 of the unit register circuit 38 in the dummy stage is held at an H level. Accordingly, a pulse of the trigger signal VST is supplied to the input terminal IN4 of the dummy stage at the time of starting a shift operation in each frame thus resetting a potential at the node N1 to an L level.

Figure 4:
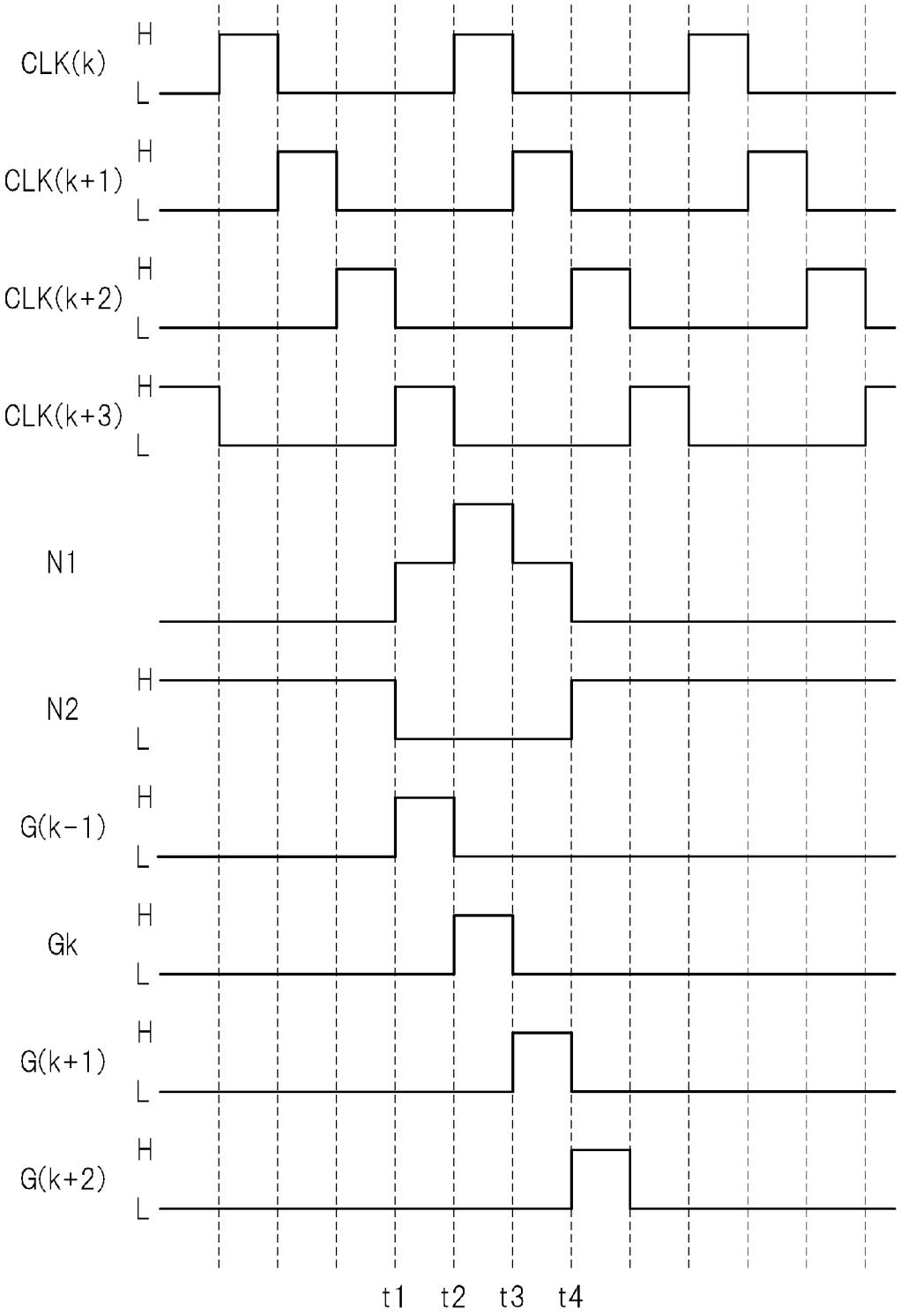
FIG. 4 is a timing chart showing waveforms of main signals relating to on operation of the unit register circuit.

FIG. 4 is a timing chart showing waveforms of main signals during a period including the output operation period of the unit register circuit 38 in the k-th stage.

The clock signal generation part 34 generates a pulse having a width of 1H in the above-mentioned order. That is, a pulse of the clock signal CLK(j+1) rises with the delay of 1H from a rise of a pulse of the clock signal CLK (j) (j: natural number satisfying $1 \leq j \leq 4$), and a pulse of the clock signal CLK1 rises with the delay of 1H from the rise of a pulse of the clock signal CLK4.

The unit register circuit 38 in a (k−1)th stage is operated before an operation of the unit register circuit 38 in a k-th stage thus outputting a pulse G(k−1). When the pulse G(k−1) is inputted to the input terminal IN3 of a k-th stage (point of time: t1), the node N1 is set to a potential corresponding to an H level, to be more specific, is set to a potential obtained by subtracting a threshold voltage of the transistor T1 from a potential of an H level so that the transistor T5 is turned on, and an inter terminal voltage of the capacitor C1 is set to the potential (starting of the output operation period). Here, the transistor T4 is turned on so that a potential at the node N2 is set to an L level. Since the transistor T7 is also turned on, the potential at the node N2 is set to an L level more speedily than a case where only the transistor T4 is turned on. The potential at the node N2 is held in the capacitor C3. Since the potential at the node N2 is held at an L level, even when the transistors TAH, TBH are turned on, the transistors T2A, T2B and T6A, T6B are held in an OFF state.

The output pulse G(k−1) of the unit register circuit 38 in a (k−1) th stage is generated in synchronism with a pulse of a clock signal CLK(k−1) (a pulse of a clock signal CLK(k+3) in FIG. 4) and hence, at a point of time t2 after a lapse of 1H from a point of time t1, a pulse of a clock signal CLK(k) is inputted to the unit register circuit 38 in a k-th stage. The pulse of the clock signal CLK(k) elevates a source potential of the transistor T5. Due to the elevation of the source potential, the potential at the node N1 is further elevated due to a bootstrap effect, and the pulse of the clock signal CLK(k) is outputted from the terminal OUT as a pulse Gk without lowering the potential. The pulse Gk is inputted to the input terminal IN3 of a (k+1) stage so that a potential at the node N1 of this stage is set to an H level.

When the pulse of the clock signal CLK(k) falls at a point of time t3, the pulse Gk also falls. On the other hand, the potential at the node N1 is held at an H level.

At a point of time t4, the unit register circuit 38 in a (k+1)th stage outputs a pulse G(k+1) in synchronism with a pulse of a clock signal CLK(k+1). In this manner, the unit register circuit 38 in each stage outputs the pulse in the own stage with the delay of 1H from outputting of the pulse by the unit register circuit 38 in the preceding stage. The unit register circuit 38 in a (k+2)th stage which receives outputting of the pulse of the (k+1)th stage outputs a pulse G(k+2) at the point of time t4 after a lapse of 1H from the point of time t3.

When a pulse G(k+2) is inputted to the input terminal IN4 of a k-th stage at the point of time t4, the transistor T8 is turned on so that a potential at the node N1 is reset to an L level. Simultaneously with such an operation, the transistor T3 is also turned on in response to a clock signal CLK(k+2) so that a potential at the node N2 is raised to an H level (completion of outputting operation period).

The transistor T3 is cyclically turned on at timings other than the point of time t4 in response to the clock signal CLK(k+2), and favorably maintains a potential at the node N2 at an H level except for the outputting operation period where the potential at the node N1 is set to an H level. Further, during the period other than the outputting operation, the transistors T2A, T2B favorably maintain a potential at the node N1 at an L level. In the period other than the outputting operation period, the transistor T5 is maintained in an OFF state, and a potential at the output terminal OUT during the period is set by the transistors T6A, T6B.

Figure 5:
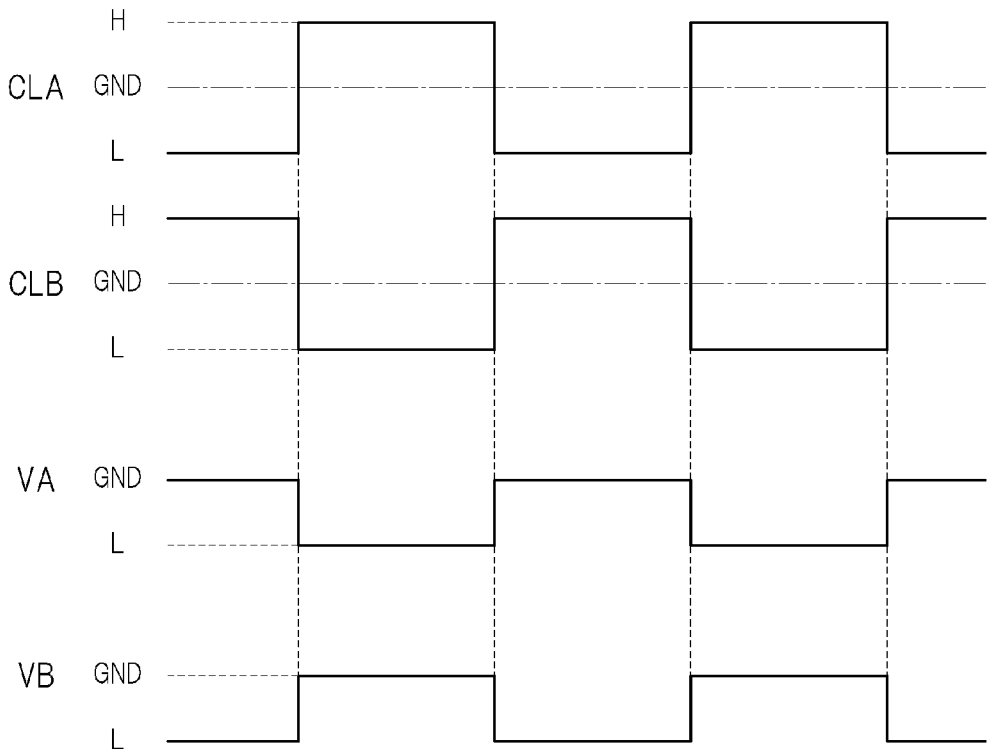
FIG. 5 is a view showing a change with time of a clock signal and a voltage of an AC power source relating to an operation of an output terminal switch and a gate terminal switch.
Figure 6:
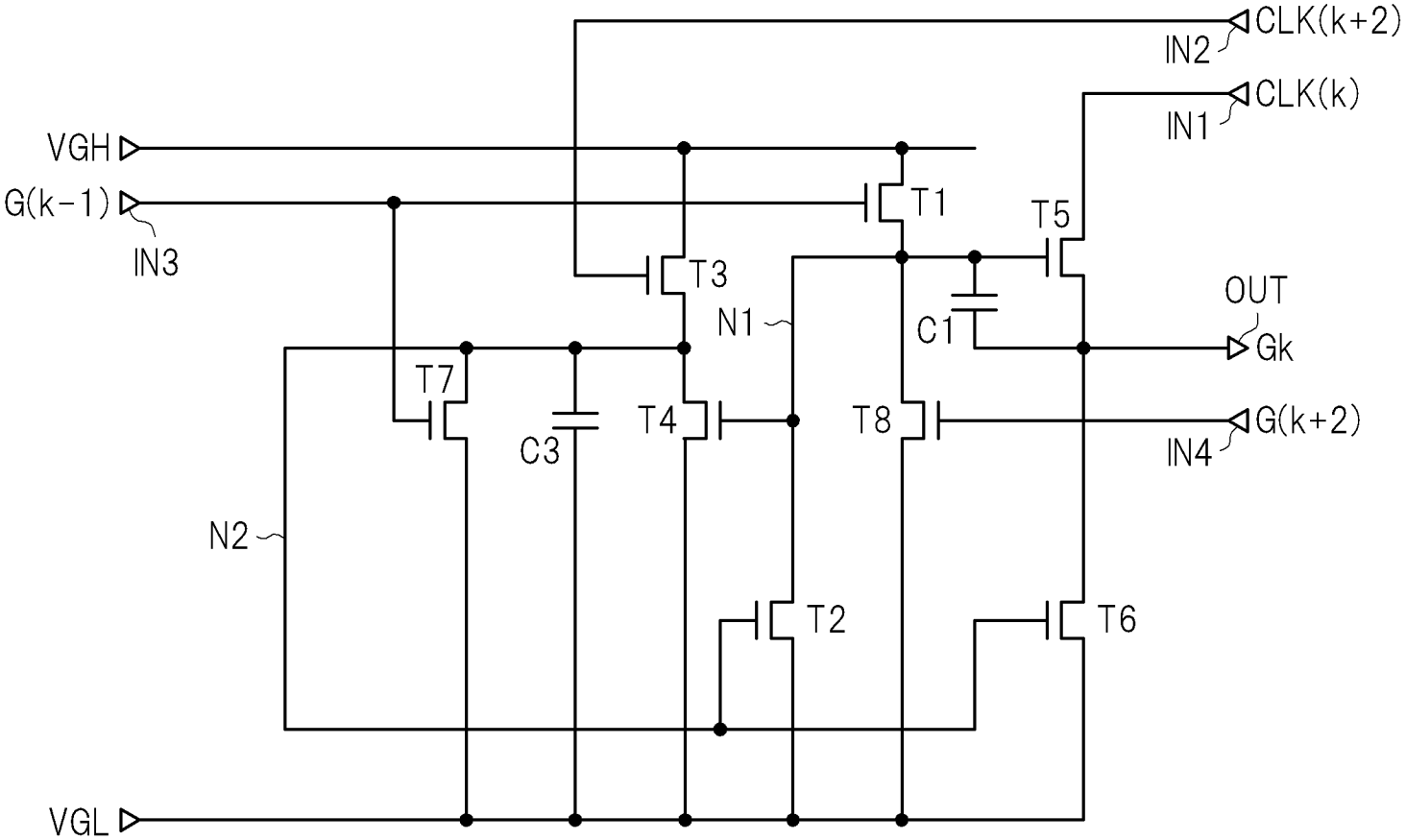
FIG.6 PRIOR ART
FIG. 6 is a circuit diagram of a basic register circuit relating to a prior art.

FIG. 5 is a view showing a change with time of clock signals CLA, CKB and voltages of the AC power sources VA, VB. Time is taken on an axis of abscissas, and voltage is taken on an axis of ordinates. As described previously, the clock signals CLA, CKB are outputted in such a manner that an H level and an L level are cyclically changed over with phases set opposite to each other. Further, the AC power sources VA, VB respectively output a potential of an L level during a period where the clock signals CLA, CLB are at an H level, and output a ground potential GND which is used as an intermediate potential during a period where the clock signals CLA, CLB are at an L level.

During a period where the clock signal CLA is at an H level and the clock signal CLB is at an L level, the transistors TAH and TBL are an ON state, while the transistors TAL and TBH are an OFF state During the period other than the outputting operation period, a potential at the node N2 is at an H level and hence, a potential at the node N2A is set to an H level through the transistor TAH in an ON state whereby the transistors T2A, T6A are turned on. In the transistors T2A, T6A which are brought into an ON state, the AC power source VA which outputs a potential of an L level is connected to the node N1 and the output terminal OUT respectively. On the other hand, the node N2B is connected to the clock signal CLB through the transistor TBL, and a potential at the node N2B is set to an L level which is outputted to the clock signal. As a result, the transistors T2B, T6B are brought into an OFF state. In such a state, a ground potential GND is applied to sources of the transistors T2B, T6B from the AC power source VB, and a bias voltage opposite to a bias voltage when the transistors T2B, T6B are in an ON state is applied between a gate and the source of the transistors T2B, T6B.

During a period where the clock signal CLA is at an L level and the clock signal CLB is at an H level, a state of the transistors T2A, T2B and the state of the transistors T6A, T6B are exchanged compared to the period where the clock signal CLA assumes an H level and the clock signal CLB assumes an L level. That is, when the transistors TBH, TAL are an ON state and the transistors TBL and TAH are an OFF state during the period other than the outputting operation period, a potential at the node N2B is set to an H level through the transistor TBH and hence, the transistors T2B, T6B are turned on so that the AC power source VB which outputs a potential of an L level is connected to the node N1 and the output terminal OUT respectively. Further, a potential at the node N2A is set to an L level which is outputted to the clock signal CLA through the transistor TAL and hence, the transistors T2A, T6A are brought into an OFF state. In such a state, a ground potential GND is applied to the transistors T2A, T6A from the AC power source VA so that a bias voltage opposite to a bias voltage when the transistors T2A, T6A are in an ON state is applied between a gate and a source of the transistors T2A, T6A.

In this manner, during the period other than the outputting operation period, either one of the transistors T6A, T6B which are output terminal switches always applies a potential of an L level to the output terminal OUT and either one of the transistors T2A, T2B which are gate terminal switches always applies a potential of an L level to the node N1.

On the other hand, the transistor T6A and T6B are alternately turned on and the transistor T2A and the transistor T2B are alternately turned on and hence, the period where each transistor is in an ON state becomes short so that a Vth shift can be reduced.

Further, a reverse bias voltage is applied to each transistor during the period where the transistor is in an OFF state and hence, the Vth shift advances in the opposite direction. That is, a threshold voltage which is elevated by the Vth shift in a state where the transistors T2A, T6A are an ON state is lowered in a state where the transistors T2A, T6A are an OFF state so that the threshold voltage can be restored.

Here, an intermediate potential which is supplied to the sources of the transistors T6A, T6B and T2A, T2B from the AC power source when these transistors are an OFF state can be determined by taking power consumption into consideration in addition to an effect of recovering the shifted threshold value Vth. Although a speed at which the threshold voltage Vth is recovered can be increased along with the increase of the reverse bias voltage, the reverse bias voltage may be set in accordance with a necessary recovery speed. The necessary recovery speed is determined by taking a balance between a shift amount of the threshold voltage Vth and a length of an OFF period of the transistor which becomes a recovering time into consideration. By taking such a necessary recovery speed into consideration, it is unnecessary to set a potential at the AC power source supplied to the source during the recovery period to an H level, and an intermediate potential lower than a potential of the H level is sufficient. On the other hand, to realize the reduction of power consumption, the decrease of amplitude of the AC power source is effective from one point of view. To take the reduction of power consumption into consideration, the potential difference between a potential of the L level and the intermediate potential may preferably be set small by lowering the intermediate potential. From another point of view, energy conversion efficiency at the time of generating an intermediate potential is considered. In newly generating an intermediate potential from a potential of an H level, an L level and a ground potential GND which are prepared as common power sources of the drive circuit, in a power source circuit which generates such an intermediate potential, the conversion of input power into the intermediate potential by 100% is not acquired in an actual operation. That is, energy is consumed in the circuit, and some of input power is converted into heat in general. From this point of view, the ground potential GND is an intermediate potential between an H level and an L level and is originally present without performing potential conversion and hence, the ground potential GND can be preferably used as the intermediate potential supplied to the source from the AC power source in a state where the transistors T6A, T6B and T2A, T2B are in an OFF state.

The higher the potential applied to the source when the transistors T6A, T6B, T2A and T2B are in an OFF state, the more easily a leak current of the transistor is liable to be generated. The increase of the leak current brings about a result against the purpose of providing the transistor that the potential at the output terminal OUT or the node N1 is maintained at an L level, and also the wasteful power consumption. Also from this point of view, it is preferable to set the potential applied to the source when the transistors T6A, T6B, T2A and T2B are in an OFF state to the intermediate potential lower than the H level.

As has been explained previously, an ON/OFF state of the transistors T6A, T6B and T2A, T2B is changed over when an output voltage of the clock signal CLA, CKB or the AC power source VA, VB shown in FIG. 5 is changed over. It is desirable that this switching is performed during a retracing period in which the shift register 30 does not output a drive signal out of a frame period. Accordingly, it is desirable that a period during which the clock signal CLA, CKB or AC power source VA, VB continues one potential is integer times as long as a frame period.

In this embodiment, two transistors T6A, T6B are provided parallel to each other as the output terminal switches at the output terminal OUT. However, the number of output terminal switches may be increased. For example, m pieces of (m being 3 or more) output terminal switches may be provided, and m pieces of AC power sources corresponding to the respective output terminal switches may be provided. In such a constitution, m pieces of output terminal switches are controlled such that at least one of these output terminal switches is brought into an ON state and these output terminal switches are alternately brought into an OFF state during period other than an outputting operation period in the operation period of the shift register (period of a shift operation performed one time or plural times). m pieces of AC power sources supply an intermediate potential during at least a portion of a period during which the corresponding output terminal switches are in an OFF state, and output a potential of an L level which is outputted from the output terminal OUT during other periods.

In the same manner, the number of gate terminal switches connected to the node N1 parallel to each other may be set to three or more. That is, for example, m pieces of gate terminal switches may be provided, and m pieces of AC power sources corresponding to the respective gate terminal switches may be provided. m pieces of gate terminal switches are controlled such that at least one of these gate terminal switches is brought into an ON state and these gate terminal switches are alternately brought into an OFF state during period other than an outputting operation period. m pieces of AC power sources supply an intermediate potential during at least a portion of a period during which the corresponding gate terminal switches are in an OFF state, and output a potential of L level which is set at a node N1 during other periods.

In this manner, when the number of the output terminal switches or the gate terminal switches is increased, the OFF period of the respective switches can be prolonged correspondingly so that a sufficient recovery effect can be achieved even with an intermediate potential which recovers the Vth shift at a small speed. Accordingly, by an amount that requirement with respect to a recovery speed is alleviated, the intermediate potential can be set such that the power consumption can be more preferably reduced.

In the above-mentioned embodiment the a-Si transistor is used as the transistor. However, the substantially equal advantageous effect can be obtained by applying the present invention explained in the above-mentioned embodiment to a drive circuit of an image display device using transistors which have a possibility of giving rise to a problem on a Vth shift.

For example, the present invention is also applicable to a drive circuit which uses a TFT where a semiconductor layer is formed of poly silicon.

In the above-mentioned embodiment, the unit register circuit supplies a selective pulse to the pixels in one row. However, it may be possible to adopt a unit register circuit which supplies selective pulse to pixels on a plurality of rows, for example. Further, in a drive method where pixel blocks which are formed by dividing a display area in a matrix array are selected sequentially by a shift register, the present invention is also applicable to such a shift register.

As has been explained heretofore in conjunction with the embodiment, according to the present invention, it is possible to acquire a drive circuit and an image display device where a Vth shift of a transistor during a period other than an outputting operation period can be suppressed with relatively small power consumption.

While there have been described what are at present considered to be certain embodiments of the invention, it will be understood that various modifications may be made thereto, and it is intended that the appended claims coverall such modifications as fall within the true spirit and scope of the invention.

What is claimed is:

1. A drive circuit for driving a display panel including a plurality of pixels, the drive circuit comprising:

a plurality of unit drive circuits which are provided for respective groups formed by dividing the plurality of pixels, each unit drive circuit outputting a drive signal which becomes a first potential at the time of driving the group of pixels and becomes a second potential at the time of non-driving the group of pixels during a common control period among the groups of pixels; and first to n-th power source circuits (n being a natural number of 2 or more) each of which selectively outputs a third potential which is an intermediate potential between the first potential and the second potential and the second potential, each unit drive circuit comprising:

a selective pulse output circuit which outputs a selective pulse having the first potential during an outputting operation period set sequentially in the control period for every group of pixels; and a k-th output terminal switch which is comprised of a transistor and which establishes or interrupts the connection between an output terminal of the unit drive circuit and the k-th power source circuit (k being an integer satisfying $1 \leq k \leq n$), wherein at least one of the first to n-th output terminal switches is brought into an ON state, and the output terminal switches are alternately brought into an OFF state during the control period other than the outputting operation period, and wherein the k-th power source circuit is configured to output only the second potential which is inputted to a source of the k-th output terminal switch during a period where the k-th output terminal switch is in an ON state and to output the third potential which is inputted to the source of the k-th output terminal switch within at least a portion of a period where the k-th output terminal switch is in an OFF state.

2. The drive circuit according to claim 1, wherein the selective pulse output circuit includes a transistor which is turned on when the first potential is applied to a gate terminal thereof and is turned off when the second potential is applied to the gate terminal thus establishing or interrupting the connection between a clock signal line and the output terminal, and outputs the selective pulse in response to a clock pulse from the clock signal line by turning on the transistor during the outputting operation period, wherein the unit drive circuit further includes a k-th gate terminal switch which is formed of a transistor and establishes or interrupts the connection between the gate terminal and the k-th power source circuit, and wherein the k-th gate terminal switch is operated in synchronism with the k-th output terminal switch.

3. The drive circuit according to claim 1, wherein the output terminal switch is formed of an amorphous silicon thin film transistor.

4. The drive circuit according to claim 2, wherein the gate terminal switch is formed of an amorphous silicon thin film transistor.

5. The drive circuit according to claim 1, wherein the third potential is a ground potential of the drive circuit.

6. An image display device comprising:

the drive circuit described in claim 1; and a display panel driven using the drive circuit.

7. A drive circuit for driving a display panel including a plurality of pixels, the drive circuit comprising:

a plurality of unit drive circuits which are provided for respective groups formed by dividing the plurality of pixels, each unit drive circuit outputting a drive signal whose potential is changed over between at the time of driving the group of pixels and at the time of non-driving the group of pixels during a common control period among the groups of pixels; and first to n-th power source circuits (n being a natural number of 2 or more) each of which selectively outputs a third potential which is an intermediate potential between a first potential and a second potential and the second potential, each unit drive circuit comprising:

a selective pulse output circuit which includes a transistor which is turned on when the first potential is applied to a gate terminal thereof and is turned off when the second potential is applied to the gate terminal thus establishing or interrupting the connection between a clock signal line and an output terminal of the unit drive circuit, and outputs a selective pulse to the drive signal in response to a clock pulse from the clock signal line by turning on the transistor during an output operation period set sequentially during the control period for every group of pixels; and a k-th gate terminal switch which is comprised of a transistor and which establishes or interrupts the connection between the gate terminal of the transistor and the k-th power source circuit (k being an integer satisfying $1 \leq k \leq n$), wherein at least one of the first to n-th gate terminal switches is brought into an ON state, and the gate terminal switches are alternately brought into an OFF state during the control period other than the outputting operation period, and wherein the k-th power source circuit is configured to output only the second potential which is inputted to a source of the k-th gate terminal switch during a period where the k-th gate terminal switch is in an ON state and to output the third potential which is inputted to the source of the k-th gate terminal switch within at least a portion of a period where the k-th gate terminal switch is in an OFF state.

8. The drive circuit according to claim 7, wherein the gate terminal switch is formed of an amorphous silicon thin film transistor.

9. The drive circuit according to claim 7, wherein the third potential is a ground potential of the drive circuit.

10. An image display device comprising:

the drive circuit described in claim 7; and a display panel driven using the drive circuit.

* * * * *